United States Patent [19]

Sachs

[11] 4,309,452

[45] Jan. 5, 1982

[54] DUAL GLOSS COATING AND PROCESS THEREFOR

[75] Inventor: Peter R. Sachs, New Windsor, N.Y.

[73] Assignee: GAF Corporation, New York, N.Y.

[21] Appl. No.: 192,586

[22] Filed: Oct. 1, 1980

[51] Int. Cl.[3] ..... B05D 3/06

[52] U.S. Cl. ..... 427/44; 427/54.1; 204/159.19

[58] Field of Search ..... 427/44, 54.1; 204/159.19

[56] References Cited

U.S. PATENT DOCUMENTS

| | | | |
|---|---|---|---|
| 3,918,393 | 11/1975 | Hahn | 427/44 |
| 3,953,622 | 4/1976 | Wismer et al. | 427/54.1 |
| 4,048,036 | 9/1977 | Prucnal | 204/159.19 |
| 4,122,225 | 10/1978 | Holmstrom et al. | 427/44 |
| 4,170,663 | 10/1979 | Hahn et al. | 427/44 |
| 4,180,615 | 12/1979 | Bettoli | 427/54.1 |
| 4,210,693 | 7/1980 | Regan | 427/44 |

*Primary Examiner*—John H. Newsome

*Attorney, Agent, or Firm*—James Magee, Jr.; Joshua J. Ward

[57] ABSTRACT

An article having a dual gloss coating is formed by:

(a) applying a first layer of radiation curable material to a substrate and partially curing with ionizing irradiation or ultraviolet light in an oxygen containing atmosphere; and (b) then applying a second layer of radiation curable material to selected areas of the first layer and completely curing both the first and second layers with ionizing irradiation or ultraviolet light in an inert atmosphere.

8 Claims, No Drawings

DUAL GLOSS COATING AND PROCESS THEREFOR

BACKGROUND OF THE INVENTION

Radiation curable coatings for use on a variety of substrates and curable by exposure to ionizing irradiation or ultraviolet light are well known. The use of urethane type coatings cured with ultraviolet light to provide protective wear layers for wall or floor tile is for instance described in U.S. Pat. No. 4,180,615. U.S. Pat. No. 3,918,393 describes a method for obtaining a non-glossy coating on various substrates by curing radiation sensitive material with ionizing irradiation or ultraviolet light in two stages. In this process the coating is partially cured in an oxygen-containing atmosphere and the curing is completed in an inert atmosphere. U.S. Pat. No. 4,122,225 discloses method and apparatus for coating tile which involves the application on one coat of radiation curable material to an entire substrate followed by partial curing and the subsequent application and curing of a second coat of radiation curable material only on high areas of the substrate which are subject to greater than average wear.

SUMMARY OF THE INVENTION

Product of the invention is a coated article comprising a substrate with a dual gloss coating adhered thereto. The dual gloss coating has selected areas of a different gloss from the remainder of the coating and comprises cured coating of radiation curable material. In a preferred embodiment the coated article of the invention has a dual gloss wear layer wherein the wear layer comprises urethane compound photo-polymerized from a fluid coating composition comprising at least two photo-polymerizable ethylenically unsaturated groups of the general structure

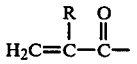

where R is either H or $CH_3$.

The process of the invention is a method of forming a dual gloss coating on a substrate comprising:

(a) applying to the substrate a first layer of radiation curable material and subjecting such layer to ionizing irradiation or ultraviolet light in an atmosphere of at least about 5,000 parts per million (ppm) oxygen until the radiation curable material is cured except for its surface; and (b) then applying to selected areas of the surface of the thus partially cured first layer a second layer of the same or a different radiation curable material and subjecting the second layer as well as at least the surface of the first layer to ionizing irradiation or ultraviolet light in an inert atmosphere containing less than about 1,000 ppm oxygen to thereby complete the cure of the first layer and completely cure the second layer.

In preferred embodiments of the invention, the second layer of radiation curable material applied to the substrate is a higher gloss material than the first layer and the substrate is embossed with the second layer being applied only to non-embossed areas of the substrate.

DETAILED DESCRIPTION OF THE INVENTION

The invention contemplates the formation of dual gloss coatings on a wide variety of substrates including such diverse materials as wood, glass, plastics, metals, paper, etc. The invention has particular applicability to tiles and decorative sheet covering material suitable for use on walls and floors, especially vinyl tiles and sheet vinyl. While the invention is applicable wherever a dual gloss, radiation cured coating is desired, especially striking results are obtained where the substrate is embossed and it is desired to provide a radiation cured coating having different gloss levels in the embossed and unembossed areas of the substrate.

Radiation curable coatings suitable for use in the invention may in general be selected from any of the coating materials known to be suitable for curing with ionizing irradiation or ultraviolet light. In this respect, ultraviolet light is generally considered to be light having wavelengths in the range of from about 2500 Å to about 4000 Å. The term "ionizing irradiation" is generally considered to include high energy radiation and/or secondary energies resulting from conversion of electrons or other particle energy to x-rays or gamma radiation. While various types of ionizing irradiation are suitable, for instance x-ray or gamma rays, the radiation produced by accelerated high energy electrons generally known as electro beam radiation, has been found to be convenient and economical and to give satisfactory results. Ionizing irradiation equivalent to at least about 100,000 electron volts is generally satisfactory. Ultraviolet light is, however, an especially preferred form of radiation for use in the invention.

Radiation curable coatings used in the invention are preferably applied in the form of layers, each of which is between about 0.01 and about 0.15 millimeter (mm) thick, with the overall thickness of the two layers used being generally between about 0.01 and about 0.25 millimeter. With coatings of such thickness, the amount of ionizing irradiation ultraviolet light is usually between about 0.2 megarad and about 20 megarads in each of the two curing operations involved. The total dosage is frequently between about 0.2 and about 30 megarads or more. In this respect a rad is defined as that amount of radiation required to supply 100 ergs of energy per gram of material treated, and a "megarad" is $10^6$ rads.

The term dual gloss coating as used herein is intended to refer to a coating in which selected areas have different gloss characteristics from other areas of the coating. The 60° glossmeter test (ASTM D523-67) is a standard test for evaluating gloss and is the basis for gloss values referred to herein. It is generally preferred that product of the invention have a dual gloss coating, wherein selected areas of the coating have a gloss at least about 20 units higher or lower than the gloss of the areas of the coating. As explained herein, this may be accomplished by the use of the two stage curing and coating method described herein. The coating materials used for the two different layers described herein may be of the same gloss, i.e. materials which if coated and cured independently by the same process would have the same gloss after curing or may be of different gloss characteristics. In a preferred embodiment, the two materials are of different gloss characteristics, preferably differing from each other by at least about 20 units of gloss. As used herein, the term "low gloss" refers to materials have a gloss after coating and curing of less that about 60 units while "high-gloss" refers to materials having a gloss after coating and curing of about 80 units.

In general, any radiation curable coatings may be used in the invention, including those mentioned in the above mentioned U.S. Pat. No. 3,918,393. Preferred coatings are, however, the urethane coatings described in U.S. Pat. No. 4,180,615, wherein the cured coating is formed from a fluid coating composition comprising at least two photo-polymerizable ethylenically unsaturated groups of the general structure:

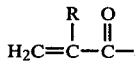

where R is either H or $CH_3$.

Any conventional coating method may be used to apply coatings for use in the invention. Such conventional methods as roll coating, spraying, dip coating and the like are, for instance, suitable for the first coating with roll coating being required for the second coating.

In practicing the process of the invention, the first layer of radiation curable coating material is coated onto the substrate and cured by exposure to ionizing irradiation or preferably ultraviolet light in an oxygen containing atmosphere containing at least about 5,000 ppm of oxygen. Air is, for instance, a suitable atmosphere for this purpose. The curing in the oxygen containing atmosphere is only a partial cure in the sense that the curing is carried out only to the point where the layer is at least gelled and optionally completely cured throughout a portion of its thickness, but in any event only to the point where at least the surface of the first layer remains partially uncured and at least somewhat tacky. Curing of the surface of the first layer is completed at the same time as curing of the second layer.

Following the application and partial curing of the first layer of radiation curable coating material in an oxygen containing atmosphere, a second layer of the same or a different coating is applied to the least partially uncured first layer in selected areas only and the entire coating, i.e. both layers, is then subjected to complete curing in an inert atmosphere containing less than about 1,000 ppmm oxygen and frequently less than about 250 ppm oxygen. Gases such as nitrogen, helium, etc. are, for instance, suitable for providing the inert atmosphere.

In order to obtain coating materials of different gloss characteristics, entirely different compositions may be used or coatings of the same basic composition may be used with known gloss reducing additives such as silica or pigment being added to reduce the gloss of the material for one of the layers.

For a better understanding of suitable substrates and radiation curable coatings, as wwell as techniques for curing such coatings and making tiles having radiation cured coatings, reference may be had to U.S. Pat. Nos. 3,918,893, 4,122,225, 4,180,615 and 3,293,094 the disclosures of which are incorporated herein by reference.

The following examples are intended to illustrate the invention without limiting the scope thereof.

Viscosity of radiation curable coatings used in the invention may vary widely depending upon the particular coating technique employed. In a preferred embodiment in which roll coating is used, the viscosity is preferably between about 1,000 and about 3,000 centipoises (cp) at 77° F.

Various conventional additives for radiation curable coatings may of course be present in coatings of the invention. These include such materials as pigments, fillers, dyes, thermoplastic additives, plasticizers, synthetic resins, heat and light stabilizers, photo-initiators, filler such as carbon black, glass fibers, silica, etc.

Coating compositions for use in the invention are preferably substantially free of non-reactive solvent, i.e. contain no more than about 5 wt % solvent. Total inactive ingredients, such as the additives and non-reactive solvent mentioned above, where used, are preferably present in amounts of no more than about 10 wt %.

Where the preferred urethane type coating compositions described above are used and cured by ultraviolet light, photosensitizers are generally employed in amounts between about 0.5 to about 5% by weight of the composition. Such preferred composition also preferably includes one or more mono or di-functional vinyl monomers, copolymerizable under ultraviolet radiation with the above indicated urethane compounds used in the coating composition. The monomer functions to reduce the viscosity of the compound and is preferably of low vapor pressure to prevent evaporative loss during application and curing. The monomer must also be sufficiently stable to prevent premature gellation or reaction with the urethane compounds prior to exposure to ultraviolet light for curing of the coating. If desired, small amounts of polymerization inhibitors may be added for this purpose. Suitable monofunctional monomers include, for instance, acrylates or methacrylates having the formula:

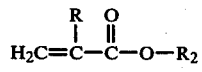

where $R_1$ is H or $CH_3$ and $R_2$ is an alkyl or cycloalkyl group having 6 to 18 carbon atoms, a phenoxyalkyl group of 6 to 18 carbons or hydroxyalkyl group. Suitable monomers are described in greater detail in the above mentioned U.S. Pat. No. 4,180,565.

EXAMPLE

A conventional printed and valley embossed vinyl tile was direct roll coated with a layer approximately 0.025 millimeter (mm) thick of a UV curable low gloss urethane wear layer coating (PPG R64N74). This coating was applied at a temperature of about 100° F. over the entire surface of the tile, including both land and valley areas. The tile was then subjected to ultraviolet radiation in an air atmosphere containing more than 5,000 PPM oxygen to effect a partial cure of the coating whereby the surface of the tile remained slightly tacky. The same tile was roll coated on unembossed areas of the tile only with a layer about 0.038 mm thick of a high gloss UV curable urethane coating (Grace 9311G) at a temperature of about 80°–90° F. This second coat was applied only to non-embossed areas of the tile, leaving the embossed areas covered only with the first coating. Following application of the second coating to the non-embossed areas, the tile was again subjected to ultraviolet radiation to complete the cure of the first coating and to cure the second coating. This time the UV cure took place in an inert atmosphere of nitrogen containing less than 1,000 PPM oxygen. Each cure involved passing the tile underneath three UV lamps rated at 200 wats/in$^2$, at a line speed of about 125 feet per minute. Following the second cure, the non-embossed areas of the tile had a gloss of about 90 units while the embossed areas had a gloss of about 40 units.

While the invention has been described above with respect to certain embodiments thereof, it will be appreciated that various changes and modifications may be made without departing from the spirit and scope of the invention.

What is claimed is:

1. Method of forming a dual gloss coating on a substrate comprising:

(a) applying to the substrate a first layer of radiation curable material and subjecting such layer to ionizing irradiation or ultraviolet light in an atmosphere containing at least about 5,000 ppm oxygen until the radiation curable material is cured except for its surface; and (b) then applying to selected areas of the surface of the thus partially cured first layer a second layer of the same or a different radiation curable material and subjecting the second layer of material as well as at least the surface of the first layer to ionizing irradiation or ultraviolet light in an inert atmosphere containing less than about 1,000 ppm oxygen to thereby completely cure said second layer and complete the cure of the first layer.

2. Method according to claim 1 wherein radiation curable material of said first and second layers is substantially solvent free.

3. Method of claim 1 wherein the second layer of radiation curable material has a gloss at least about 20 units greater than the material of the first layer.

4. Method according to claim 3 wherein the substrate is an embossed substrate, the first layer of material is applied in a continuous layer and the second layer of material is applied only to non-embossed areas of the substrate.

5. Method according to claim 1, wherein the coating material used for said layers of material comprises in each case fluid urethane compound containing at least two photo-polymerizable ethylenically unsaturated groups of the general structure:

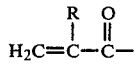

6. Method according to claim 1 wherein each of steps (a) and (b) includes subjecting the radiation curable material to ultraviolet light until a radiation dosage between about 0.2 and 20 megarads has been received by the material.

7. Method according to claim 1 wherein:

(a) radiation curable material of said first and second layers is substantially free of non-reactive solvent;

(b) the second layer of radiation curable material has a gloss at least about 20 units greater than the material of the first layer;

(c) the substrate is an embossed substrate, the first layer of material is applied as a continuous layer and the second layer of material is applied only to non-embossed areas of the substrate;

(d) the coating material used for said layers of material comprises in each case fluid urethane compound containing at least two photo-polymerizable, ethylenically unsaturated groups of the general structure:

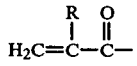

where R is either H or $CH_3$, and (e) each of steps (a) and (b) of claim 1 includes subjecting the radiation curable material to ultraviolet light until a radiation dosage between about 0.2 and about 20 megarads has been received by the material.

8. Method according to claim 7 wherein the substrate is vinyl tile base material or sheet vinyl material.

* * * * *